United States Patent [19]

Bristley

[11] Patent Number: 4,514,725

[45] Date of Patent: Apr. 30, 1985

[54] WINDOW SHADE MOUNTED ALARM SYSTEM

[76] Inventor: Barbara E. Bristley, 1100 Ball St., Fremont, Ohio 43420

[21] Appl. No.: 451,013

[22] Filed: Dec. 20, 1982

[51] Int. Cl.[3] ..... G08B 7/00; G08B 23/00

[52] U.S. Cl. ..... 340/691; 340/531; 340/815.21; 40/457

[58] Field of Search ..... 340/691, 531, 815.21, 340/815.22, 811, 813, 715, 693, 330, 331; 40/457, 427; 116/202

[56] References Cited

U.S. PATENT DOCUMENTS

| | | | |
|---|---|---|---|
| 1,500,706 | 7/1924 | Isom | 340/691 X |
| 3,280,341 | 10/1966 | DuVall | 340/813 X |
| 3,461,448 | 8/1969 | Kramer | 340/326 X |
| 3,525,988 | 8/1970 | Linder | 340/691 X |
| 3,624,635 | 11/1971 | Less | 340/815.22 X |
| 3,750,131 | 7/1973 | Read et al. | 340/531 X |
| 3,787,752 | 1/1974 | Delay | 340/813 X |
| 4,055,014 | 10/1977 | Schmidt et al. | 40/457 X |
| 4,207,696 | 6/1980 | Hyman et al. | 40/457 X |
| 4,258,291 | 3/1981 | Scott et al. | 340/628 X |
| 4,297,677 | 10/1981 | Lewis et al. | 340/691 X |
| 4,410,887 | 10/1983 | Stolov et al. | 340/784 |

FOREIGN PATENT DOCUMENTS

| | | | |
|---|---|---|---|
| 51896 | 4/1977 | Japan | 340/531 |
| 131723 | 11/1978 | Japan | 340/691 |

*Primary Examiner*—Jerry W. Myracle
*Assistant Examiner*—Tom Noland
*Attorney, Agent, or Firm*—Fraser & Clemens

[57] ABSTRACT

A home alarm system for mounting on a retractable window shade includes a display for summoning outside help in an emergency situation. The system includes a sound sensor, such as a microphone, for detecting audible noises in a room of the home and for generating electrical signals in response thereto. A driver circuit is responsive to the electrical signals generated by the microphone for actuating a visual display only when a predetermined sound, such as the alarm signal from a conventional fire, smoke, or intruder alarm, is detected. The visual display is attached to the outwardly facing surface of the window shade such that it can be viewed from outside the home. The display can be formed with any small or flexible device capable of being rolled up with the window shade during periods of nonuse. Types of display disclosed include light emitting diodes, liquid crystal displays, and electro-luminescent strips.

16 Claims, 3 Drawing Figures

WINDOW SHADE MOUNTED ALARM SYSTEM

BACKGROUND OF THE INVENTION

1. Field of the Invention

The present invention relates in general to home security devices and in particular to an alarm system adapted for mounting on a retractable window shade in a home for summoning outside help in an emergency situation.

2. Description of the Prior Art

Many devices are known in the art for detecting an emergency condition in a home, such as the presence of smoke, fire, or an intruder, and for generating an audible alarm signal to alert the occupants of the home who may be asleep or otherwise inattentive to the presence of the emergency condition. Also known in the art are devices which are responsive to the alarm signal generated by such an emergency condition detector for generating a signal to summon outside help for the emergency situation.

For example, U.S. Pat. No. 3,911,425 to Muncheryan discloses an alarm system for signaling emergency help during sudden illness or unauthorized intrusion. The system includes an intermittently sounding alarm device with concurrently flashing red light means which signals, by means of large letters, the word "HELP" toward a street to alert passersby. U.S. Pat. No. 4,258,291 to Scott et al. discloses a smoke alarm activated portable light or lamp for providing emergency illumination in response to an alarm signal from a smoke alarm device. Other related alarm and signal devices are disclosed in U.S. Pat. Nos. 3,461,448, 3,624,635, 3,810,170, 3,991,415, and 4,074,225.

SUMMARY OF THE INVENTION

The present invention relates to a home alarm system adapted for mounting on a retractable window shade for summoning outside help in an emergency situation. The system includes a sound sensor means, such as a microphone, for detecting audible noises in a room of the home and for generating electrical signals in response thereto. A driver circuit is responsive to the electrical signals generated by the microphone for actuating a visual display means only when a predetermined sound, such as the alarm signal from a conventional fire, smoke, or intruder alarm, is detected. The visual display means is attached to the outwardly facing surface of the window shade such that it can be viewed from outside the home. The display can be any small or flexible device capable of being rolled up with the window shade during periods of nonuse. Possible types of display means can include light emitting diodes, liquid crystal displays, and electro-luminescent strips.

It is an object of the present invention to provide an alarm and signal device adapted for mounting on the outwardly facing surface of a window shade.

It is another object of the present invention to provide an alarm and signal device which is simple in construction and inexpensive in cost.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
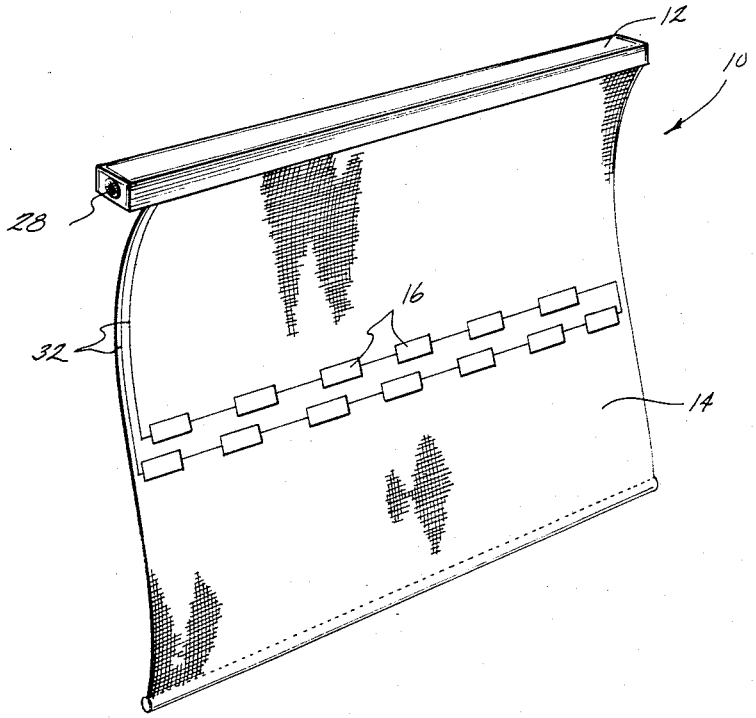
FIG. 1 is a perspective view of an alarm system mounted on a window shade in accordance with the present invention.

Referring now to the drawings, there is illustrated in FIG. 1 a window shade assembly 10 having an alarm and signal device mounted thereon in accordance with the present invention. The window shade assembly 10 is typically mounted in a window (not shown) of a house or other structure to be monitored. The window shade assembly 10 is conventional in the art and includes a rectangular headrail box 12 within which a longitudinally extending shaft (not shown) is rotatably mounted. A window shade 14 formed of cloth or other flexible material is attached to the shaft and depends downwardly therefrom. The shaft is spring loaded in conventional fashion to normally urge rotation of the shaft such that the window shade 14 is wound thereupon and retracted upwardly within the headrail 12. A conventional ratchet means (not shown) is also provided to selectively maintain the window shade in a desired extended position.

A display means is attached to the outwardly facing surface of the window shade 14. In the illustrated embodiment, the display means consists of a plurality of small electro-luminescent strips 16. The electro-luminescent strips 16 are conventional in the art and generate a visual signal when an appropriate electrical current is applied thereto. Alternatively, the display means can consist of a plurality of light emitting diodes or liquid crystal displays. Also, the display means can be arranged on the outwardly facing surface of the window shade so as to form words which would immediately alert a passerby to an emergency condition in the home, such as "HELP", "FIRE", and the like.

Figure 2:
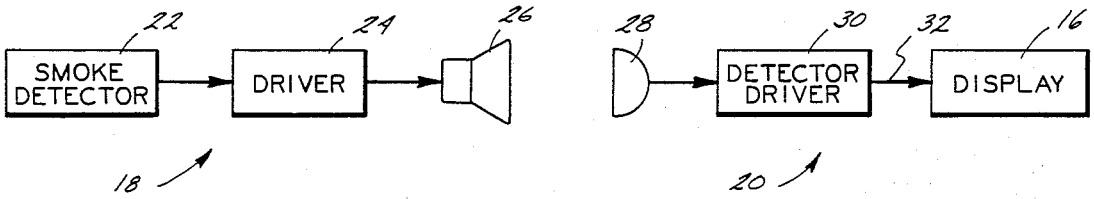
FIG. 2 is a block diagram of the alarm system of FIG. 1.

FIG. 2 illustrates a block diagram of the alarm system in accordance with the present invention. The alarm system includes a first portion 18 which is responsive to an emergency condition in the home for generating an audible signal to the occupants of the home. A second portion 20 of the alarm system is responsive to the audible signal generated by the first portion 18 for generating a visual alert signal to alert persons outside the home to summon help. The first portion 18 can be any conventional emergency condition detector means, such as a smoke, fire, or intruder alarm. Such a detector means would include, for example, a smoke detector means 22 which is responsive to the presence of smoke for generating an electrical signal to a driver circuit 24. The driver circuit 24 is responsive to the signal from the smoke detector means 22 for actuating a horn 26 to generate an audible signal to occupants of the home that the presence of smoke in the house has been detected. The first portion 18 of the alarm system is physically separate from the second portion 20 and can be placed in any convenient location in the home.

The second portion 20 of the alarm system is mounted entirely on or within the window shade apparatus 10 described above. A sound sensor means, such as a conventional microphone 28, is mounted on the headrail 12, preferably at one end thereof. The microphone 28 is responsive to all audible sounds in the room for generating electrical signals in response thereto. The signals from the microphone are fed to a detector driver circuit 30 mounted in the headrail 12. The detector driver circuit 30 is conventional in the art and is responsive only to a predetermined set of electrical signals generated by the microphone 28 for generating an appropriate electrical signal over the wires 32 to activate the electro-luminescent display 16. In accordance with the present invention, the detector driver circuit 30 is tuned to respond only to the audible alert signal generated by the horn 26 of the first portion 18 of the alarm system. Thus, when an emergency condition is detected and an audible alert signal is generated to the occupants of the house by the first portion 18 of the alarm system, a visual signal will automatically be generated to summon help from outside the house. Each portion of the system can include a conventional power supply (not shown) such as batteries.

Figure 3:
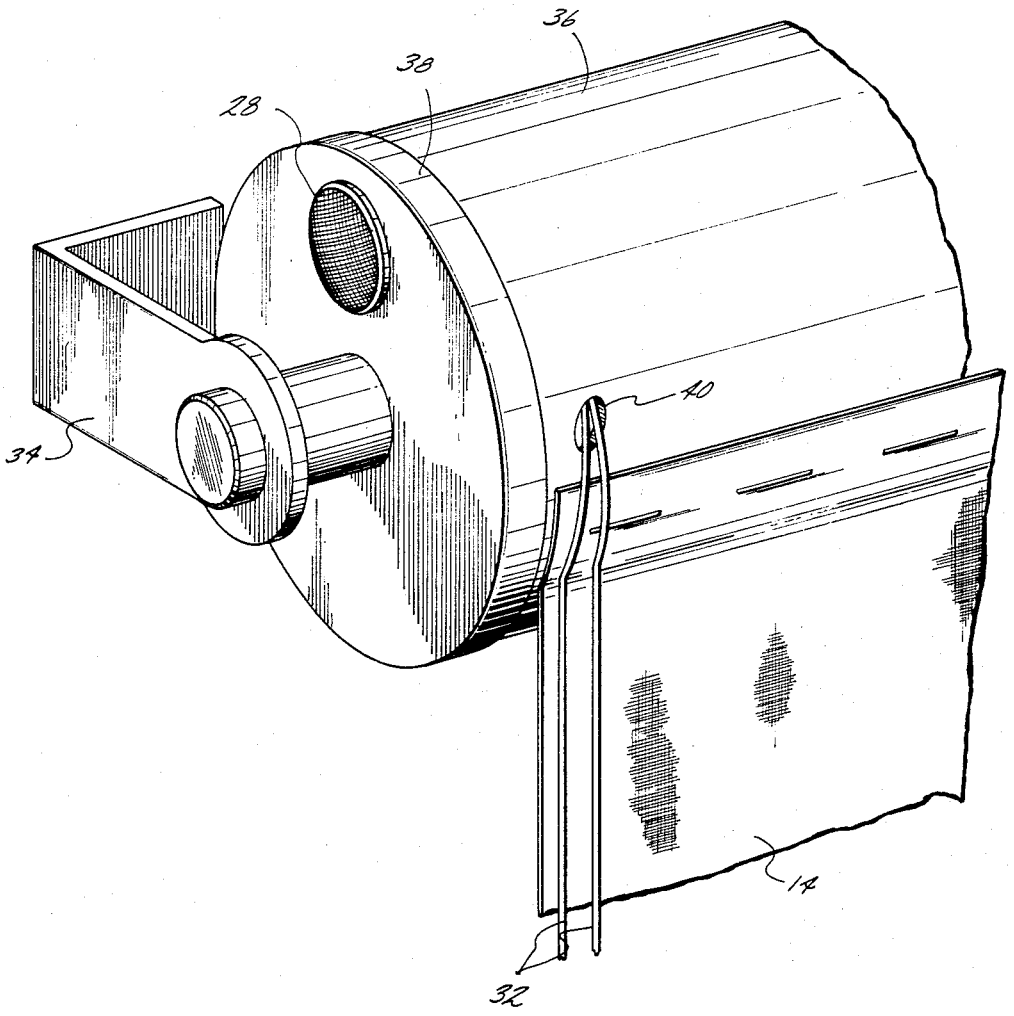
FIG. 3 is a perspective view of a portion of an alternative embodiment of the alarm system of FIG. 1.

Referring now to FIG. 3, there is illustrated an alternative embodiment of the alarm system in accordance with the present invention. In this embodiment, the headrail 12 is removed and the window shade assembly 10 is secured to a wall by a support member 34 disposed at either end of a hollow shaft 36. The hollow shaft 36 has an end cap 38 attached to either end thereof. Each end cap 38 is rotatably supported by a respective support member 34 such that the shaft 36 is free to rotate and wind the window shade 14 thereupon as described above.

The microphone 28 is mounted in an aperture formed in one of the end caps 38. The detector driver circuit 30 is contained entirely within the hollow shaft 36. The wires 32 connecting the detector driver circuit 30 to the electro-luminescent strips 16 are passed through an aperture 40 formed in the hollow shaft 36 to the outwardly facing side of the window shade 14.

The embodiment illustrated in FIG. 3 is advantageous in that all of the components of the second portion 20 of the alarm system are fixed in position with respect to one another. As shown in FIG. 3, the microphone 28 is fixed relative to the hollow shaft 36 such that the microphone 28 rotates with the hollow shaft 36. Thus, since the connections between the wires 32 and the microphone 28 are fixed relative to one another, the wire connections are not twisted and subjected to fatigue as the window shade is rolled or unrolled. In FIG. 1, since the microphone is attached to the headrail box 12 and is not fixed relative to the window shade shaft, the wire connections between the microphone 28 and the wires 32 are twisted during rolling or unrolling of the shade. Accordingly, the alternative embodiment illustrated in FIG. 3 can be manufactured with less expensive components without sacrificing reliability of the alarm system.

In accordance with the provisions of the patent statutes, the principal and mode of operation of the present invention have been explained and illustrated in its preferred embodiment. However, it must be appreciated that the present invention can be practiced otherwise than as specifically explained and illustrated without departing from its spirit or scope.

What is claimed is:

1. An alarm system comprising:

a window shade assembly mounted in a window of a structure including a retractable window shade attached to a rotatable shaft;

display means mounted on one side of said window shade and facing outwardly of the structure for selectively producing an illuminated visual alarm signal in response to an activating signal;

emergency condition detector means located within the structure for detecting an emergency condition therein and for generating an audible signal in response thereto; and means independent of the shade position and responsive to said audible signal for generating said activating signal to cause said display means to produce said illuminated visual alarm signal.

2. The invention of claim 1 wherein said display means is a plurality of light emitting diodes.

3. The invention of claim 1 wherein said display means is a plurality of liquid crystal displays.

4. The invention of claim 1 wherein said display means is a plurality of electro-luminescent strips.

5. The invention of claim 1 wherein said means for activating said display means includes sound sensor means for generating electrical signals in response to audible noises detected within the structure and detector driver circuit means responsive only to a predetermined one of said electrical signals generated by said sound sensor means for activating said display means.

6. The invention of claim 5 wherein said sound sensor means is a microphone.

7. The invention of claim 5 wherein said window shade assembly further includes a headrail for rotatably supporting said shaft, said sound sensor means and said detector driver circuit means being mounted on said headrail.

8. The invention of claim 5 wherein said shaft is hollow and said sound sensor means and said detector driver circuit means are mounted within said hollow shaft.

9. In a home having an emergency condition detector means for detecting an emergency condition therein and for generating an audible signal in response thereto, an alarm system comprising:

a window shade assembly mounted in a window of the home including a retractable window shade attached to a rotatable shaft;

display means mounted on one side of said window shade and facing outwardly of the home for selectivel producing an illuminated visual alarm signal in response to an activating signal; and means independent of the shade position and responsive to said audible signal for generating said activating signal to cause said display means to produce said illuminated visual alarm signal.

10. The invention of claim 9 wherein said means for activating said display means includes sound sensor means for generating electrical signals in response to audible noises detected within the home and detector driver circuit means responsive only to a predetermined one of said electrical signals generated by said sound sensor means for activating said display means.

11. The invention of claim 10 wherein said window shade assembly further includes a headrail for rotatably supporting said shaft, said sound sensor means and said detector driver circuit means being mounted on said headrail.

12. The invention of claim 10 wherein said shaft is hollow and said sound sensor means and said detector driver circuit means are mounted within said hollow shaft.

13. In a home having an emergency condition detector means for detecting an emergency condition therein and for generating an audible signal in response thereto and having a window shade assembly mounted in a window of the home, the window shade assembly including a retractable window shade attached to a rotatable shaft, an alarm system comprising:

display means mounted on one side of the window shade and facing outwardly of the home for selectively producing an illuminated visual alarm signal in response to an activating signal; and means independent of the shade position and responsive to the audible signal of the emergency condition detector means for generating said activating signal to cause said display means to produce said illuminated visual alarm signal.

14. The invention of claim 13 wherein said means for activating said display means includes sound sensor means for generating electrical signals in response to audible noises detected within the home and detector driver circuit means responsive only to a predetermined one of said electrical signals generated by said sound sensor means for activating said display means.

15. The invention of claim 14 wherein said window shade assembly further includes a headrail for rotatably supporting said shaft, said sound sensor means and said detector driver circuit means being mounted on said headrail.

16. The invention of claim 14 wherein said shaft is hollow and said sound sensor means and said detector driver circuit means are mounted within said hollow shaft.

* * * * *